US010278520B2

(12) United States Patent
Storace

(10) Patent No.: US 10,278,520 B2
(45) Date of Patent: May 7, 2019

(54) TRANSPORT, STORAGE AND DISPLAY CASE AND SYSTEM

(71) Applicant: Carmel Paul Storace, Millbrook (CA)

(72) Inventor: Carmel Paul Storace, Millbrook (CA)

( * ) Notice: Subject to any disclaimer, the term of this patent is extended or adjusted under 35 U.S.C. 154(b) by 46 days.

(21) Appl. No.: 15/557,205

(22) PCT Filed: Mar. 11, 2016

(86) PCT No.: PCT/CA2016/050275
§ 371 (c)(1),
(2) Date: Sep. 11, 2017

(87) PCT Pub. No.: WO2016/141493
PCT Pub. Date: Sep. 15, 2016

(65) Prior Publication Data

US 2018/0042403 A1 Feb. 15, 2018

Related U.S. Application Data

(60) Provisional application No. 62/132,279, filed on Mar. 12, 2015.

(51) Int. Cl.
*B65D 5/10* (2006.01)
*A47F 5/10* (2006.01)
(Continued)

(52) U.S. Cl.
CPC ..... *A47F 5/10* (2013.01); *A47B 47/0091* (2013.01); *A47B 87/0269* (2013.01);
(Continued)

(58) Field of Classification Search
CPC ... A47F 5/10; A47F 5/108; A47F 3/12; A47B 47/0091; A47B 87/0269; A47B 43/00; A47B 45/00; A47B 47/047; B65D 25/04
See application file for complete search history.

(56) References Cited

U.S. PATENT DOCUMENTS 4,727,994 A * 3/1988 Beaulieu ..... A47B 19/06 16/333
2009/0250422 A1* 10/2009 Clark ..... A47F 5/103 211/189

FOREIGN PATENT DOCUMENTS

DE 202005002972 U1 5/2005
WO WO-2011065096 A1 6/2011
WO WO-2013093398 A1 6/2013

OTHER PUBLICATIONS

"International Application No. PCT/CA2016/050275, International Search Report dated May 18, 2016", (May 18, 2016), 4 pgs.
(Continued)

*Primary Examiner* — Shawn M Braden
(74) *Attorney, Agent, or Firm* — Schwegman Lundberg & Woessner, P.A.

(57) ABSTRACT

A transport, storage and display case (10) and a transport storage and display case system of stacking compartments that can be interconnected and formed into multiple orientations according to the user's needs. The system is convertible between a display configuration and a stacked transport/storage configuration. Each case has rabbet ledges (62, 64) at its upper and lower edges for cooperating with adjacent cases. The outer surface of each case has one or more magnets provided to facilitate secure interaction between adjacent cases arranged in the display configuration.

16 Claims, 7 Drawing Sheets

(51) Int. Cl.

| | |
|---|---|
| ***A47B 47/00*** | (2006.01) |
| ***A47B 87/02*** | (2006.01) |
| ***B65D 21/02*** | (2006.01) |
| ***B65D 25/04*** | (2006.01) |
| ***B65D 63/00*** | (2006.01) |
| *A47F 3/14* | (2006.01) |
| *A47B 47/04* | (2006.01) |

(52) U.S. Cl.
CPC ..... *A47F 5/108* (2013.01); *B65D 21/0213* (2013.01); *B65D 25/04* (2013.01); *B65D 63/00* (2013.01); *A47B 47/047* (2013.01); *A47F 3/14* (2013.01)

(56) References Cited

OTHER PUBLICATIONS

"International Application No. PCT/CA2016/050275, Written Opinion dated May 18, 2016", (May 18, 2016), 5 pgs.

* cited by examiner

TRANSPORT, STORAGE AND DISPLAY CASE AND SYSTEM

PRIORITY APPLICATIONS

This application is a U.S. National Stage Filing under 35 U.S.C. 371 from International Application No. PCT/CA2016/050275, filed on 11 Mar. 2016, and published as WO2016/141493 on 15 Sep. 2016, which claims the benefit of priority to U.S. Provisional Application No. 62/132,279, filed on 12 Mar. 2015; which applications and publication are incorporated herein by reference in their entirety.

FIELD

The present invention pertains to the field of protective transport, storage and display cases. More specifically, the present invention relates to a transport, storage and display case and system of stacking compartments that can be interconnected and formed into multiple orientations depending upon the user's needs.

BACKGROUND

Transport, storage and display cases are used throughout the world in trade and service industries to transport, sell and store goods, tools and other objects. These cases are very important for protection and presentation, and some cases are compartmentalized to provide further organization and security.

Vendors are constantly seeking novel ways in which to ensure the protection of their goods during transport and storage. Often the protection provided in transport and storage cases is of a generic design and does not take into account the customization required for the particular needs of a specific good. Therefore, there is a need for the vendor to have the ability to quickly and easily alter the orientation of a transport or storage case in order to provide the user with a wide range of functional uses of a case, including enhanced protection for the specific good that will be transported or stored.

Vendors are also constantly seeking novel ways to display their goods for sale in a convenient and appealing way to consumers. Often, these vendors are also required to transport their goods to different locations in order to attend trade fairs or visit potential clients. Many available transport cases are cumbersome and aesthetically unappealing and so vendors are required to transport and display their goods in alternative containers. Therefore, there is need for an appealing display case that is also able to safely transport goods.

Accordingly, there is need for a transport, storage and display case that can provide both security and protection for goods during transport, along with appealing and secure display capabilities, while allowing the user to orient the case in a customized manner to suit their particular needs.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

In accordance with the present invention, there is provided a transport, storage and display system that can be used to protect goods during transport or storage, while having the capability to display goods securely and in an aesthetically appealing way. Accordingly, the present system is readily convertible between a display configuration and a stacked transport/storage configuration.

In one embodiment, the present invention provides a transport, storage and display case system convertible between a display configuration and a stacked transport/storage configuration, the system comprising (i) two or more stackable cases and (ii) a top portion. Each case comprises a bottom portion and a frame portion associated with the bottom portion. The frame portion comprises a first end portion, a second end portion a first side portion, and a second side portion. The first end portion upwardly projects from a first end of the bottom portion and transversely extends between a first side and a second side of the bottom portion; and the second end portion upwardly projecting from a second end of the bottom portion and transversely extending between the first side and the second side of the bottom portion. The first side portion extends from the first end of the bottom portion to the second end of the bottom portion and projects upwardly from the first side of the bottom portion. The second side portion extends from the first end of the bottom portion to the second end of the bottom portion and projects upwardly from the second side of the bottom portion. Each of the first and second side portion further comprise one or more magnets located on an outer surface, the magnets being provided to facilitate secure interaction between adjacent cases arranged in the display configuration. The first end portion, the second end portion, the first side portion, and the second side portion of the frame portion each have an upper edge and a lower edge, the lower edges having an outwardly oriented first rabbet ledge, the upper edges having a transversely extending, inwardly oriented second rabbet ledge, and the upper edges together forming an upper periphery of a case. The top portion is configured to longitudinally extend between the first end portion and the second end portion and transversely extend between the first side portion and the second side portion of the frame portion of the uppermost case of two or more cases in the stacked transport/storage configuration. The bottom portion is configured to engage the lower edges of the first end portion, the second end portion, the first side portion, and the second side portion of the frame portion, and the bottom portion of an upper case is shaped to engage with the upper periphery of a lower case when two or more of said cases are in the stacked transport/storage configuration.

In one embodiment, the present invention provides a transport, storage and display case system convertible between a display configuration and a stacked transport/storage configuration, the system comprising: (i) two or more stackable cases and (ii) a top portion. Each case comprises a bottom portion and a modular frame portion associated with the bottom portion. The modular frame portion comprises a central module comprising a first central side portion, a second central side portion, and at least one divider portion transversely extending between the first central side portion and the second central side portion. The modular frame portion also comprises a first end module and a second end module. Each of the first and second end modules comprises an end portion and two end side portions, one of the end side portions longitudinally extending from the end portion along the first side of the bottom portion toward the first central side portion of the central module and the other of the end side portions longitudinally extending from the end portion along the second side of the bottom portion toward the second central side portion of the central module, wherein two end side portions and the central portion together form a side portion of the modular frame portion. The first end portion, the second end portion, the first side portion, and the second side portion of the modular frame portion each have an upper edge and a lower edge, the lower edges having a transversely extending, outwardly oriented first rabbet ledge, the upper edges having a transversely extending, inwardly oriented second rabbet ledge, and the upper edges together form an upper periphery of a case. Each of the first side portion and the second side portion of the modular frame portion further comprise one or more magnets located on an outer surface, the magnets being provided to facilitate secure interaction between adjacent cases arranged in the display configuration. The top portion is configured to longitudinally extend between the first end portion and the second end portion and transversely extend between the first side portion and the second side portion of the modular frame portion of the uppermost case of two or more cases in the stacked transport/storage configuration. The bottom portion is configured to engage the lower edges of the first end portion, the second end portion, the first side portion of the frame portion, and the second side portion, and the bottom portion of an upper case is shaped to engage with the upper periphery of a lower case when two or more of said cases are in the stacked transport/storage configuration.

In one embodiment, the present invention provides a case

BRIEF DESCRIPTION OF THE FIGURES

Embodiments of the present invention will be better understood in connection with the following Figures, in which.

DETAILED DESCRIPTION OF THE EMBODIMENTS

Figure 1:
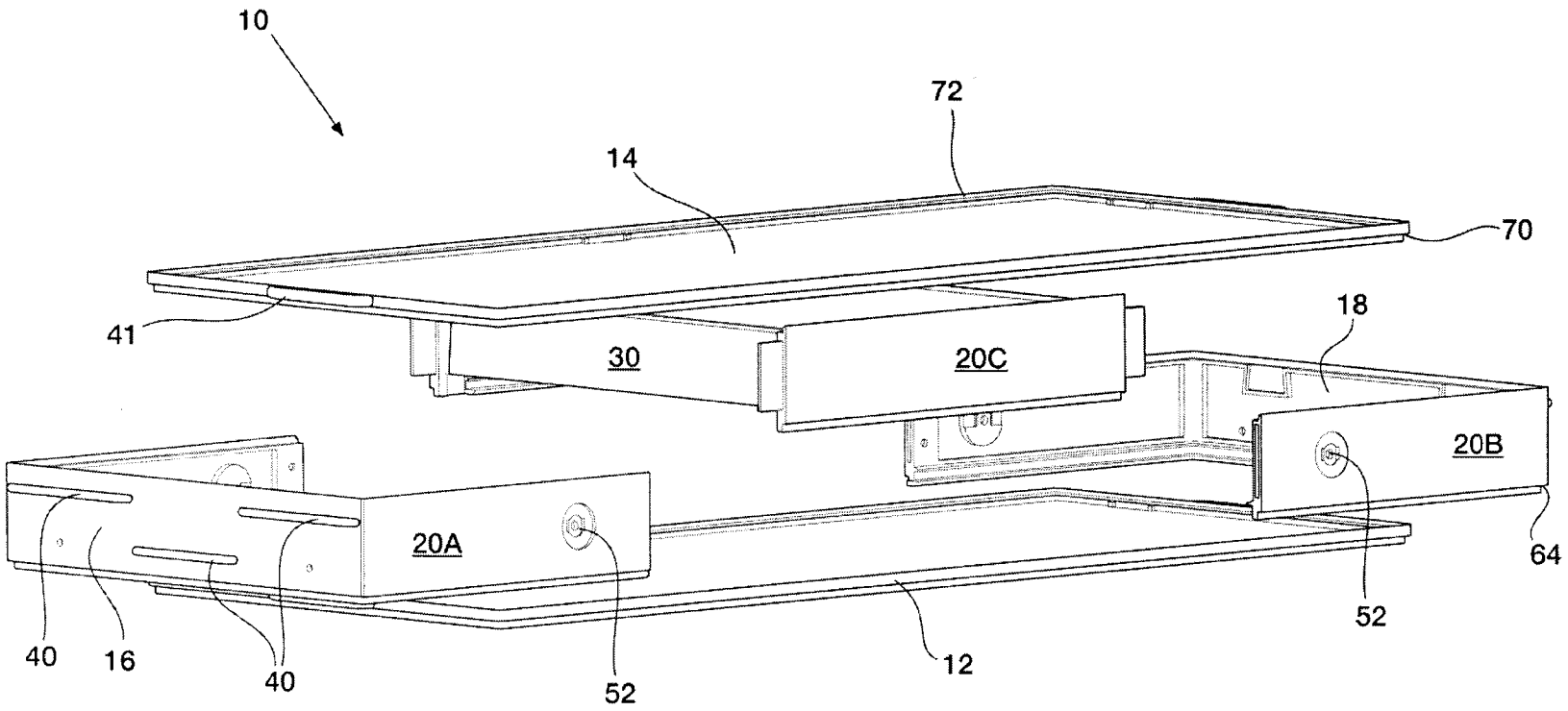
FIG. 1 illustrates an exploded perspective view of a storage case assembly including frame portion, a top portion and a bottom portion, in accordance with one embodiment of the present invention.

Unless defined otherwise, all technical and scientific terms used herein have the same meaning as commonly understood by one of ordinary skill in the art to which this invention belongs.

The present invention provides a protective transport, storage and display case and system comprising a plurality of stackable storage cases. In accordance with the present invention, the system is easily converted from a stacked transport/storage configuration to a secure display configuration. In one embodiment, the system comprises two or more stackable cases. In the transport/storage configuration, the cases are stacked for convenient transportation. In such a configuration, the bottom of an upper case acts as a cover for the case below, and the uppermost case of the stack is provided with a top configured to cover the open upper face of the case.

The system is readily converted from the transport/storage configuration to the display configuration, by unstacking the cases, and setting the respective cases side by side to facilitate display of the contents of the cases.

The individual cases are provided with magnets that are located to facilitate a secure display configuration. Accordingly, the cases can be magnetically fastened or interconnected to one another, and formed into different orientations depending upon the desired application of the system. The individual cases are further provided with magnets to facilitate secure transportation in the stacked transport/storage configuration.

In one embodiment, the system further comprises a strapping system comprising a handle and one or more straps suitably sized to wrap around the plurality of storage cases in the stacked transportation configuration to facilitate transportation. In a preferred embodiment, the strap(s) are provided with magnets located to correspond to, and interact with, magnets on the individual storage cases to provide additional security during transportation.

Further, it is contemplated that the present invention can be utilized to store, transport and display any number or type of items. For example, the system may be suitable for use in displaying and transporting retail goods. It is also contemplated that the system disclosed herein may be used in any context where flexibility in the configuration of the system is desired, for example, in the secure transport or storage of an assembled system in an irregularly shaped space.

The storage case in accordance with the present invention can generally be described as having a bottom portion, and a frame portion associated with the bottom portion, the frame portion having a first end portion, second end portion, at least one first side portion and at least one second side portion. The storage case may also be provided with a top portion (cover).

In one embodiment, each case comprises a bottom portion having a first end and a second end and a first side and a second side. Associated with each bottom portion is a frame portion, wherein the frame portion comprises a first end portion and a second end portion. Each of the end portions extends transversely between the first side and the second side of the bottom portion. The frame portion also comprises first and second side portions extending from the first end of the bottom portion to the second end of the bottom portion.

The bottom portion is configured to engage the first end portion, the second end portion, the first side portion, and the second side portion of the frame portion at their lower edges. In one embodiment, the lower edges of the first end portion, the second end portion, the first side portion, and the second side portion have an inwardly oriented flange, wherein the bottom portion is configured to rest on the inwardly oriented flange. In another embodiment, the lower edges of the first end portion, the second end portion, the first side portion, and the second side portion have an inwardly oriented channel, wherein the bottom portion is configured to fit within the inwardly oriented channel.

In one embodiment, the frame portion further comprises at least one divider portion extending between the first and second sides of the frame and/or between the first and second ends of the frame, wherein the ends of the divider portion(s) abut an inner surface of the side portions and/or end portions. The divider(s) may thus form two or more distinct compartments within the frame, the compartments being of suitable size and shape for the desired display and/or transport requirements. In a further embodiment, the system optionally includes molded inserts sized to fit within the compartments and suitably shaped to accommodate the goods being displayed.

In one embodiment of the present invention, the frame portion associated with the bottom portion is provided as a modular frame portion. In this embodiment, the modular frame portion comprises a central module and first and second end modules. In one embodiment, the central module comprises a first and second central side portion and at least one divider portion transversely extending between the first and second central side portions. In one embodiment, each of the first and second end modules comprises a respective end portion and two end side portions, each of the end side portions longitudinally extending from the end portion along a respective side of the bottom portion toward the central side portion of the central module.

In this embodiment, the first and second side portions of the frame portion are each formed of three parts, wherein the two end side portions and the first central side portion together form the side portion of the modular frame portion.

In the modular frame embodiment, the central side portion and end side portions that together form the side portion are connected via any suitable connection arrangement. One suitable arrangement is a tongue and slot arrangement, wherein a tongue on one portion projects into a corresponding slot on an adjacent portion. In one embodiment, the projecting tongue is secured within the receiving slot by way of securing means including, but not limited to, an adhesive such as glue, a mechanical fasteners such as a screw, or by frictional fit.

In a preferred embodiment of the present invention, the cases have one or more magnets located on an outer surface of the side portions and/or end portions. The magnets are located in a position that facilitates secure interaction between adjacent cases arranged in the display configuration. For example, when the cases are arranged side by side in the display configuration, the magnets on the outer surface of the side portions of adjacent cases are in a suitable position to maximize the magnetic interaction between adjacent cases, thereby providing a secure display configuration. It is also contemplated that magnets located on the outer surface of the end portions facilitate a secure end to end display configuration.

In one embodiment, the magnets are provided in recesses in the side portions and/or end portions of the cases, thereby ensuring that the sides of adjacent cases are in contact with each other while also maintaining the necessary magnetic interaction to securely hold the adjacent cases in the desired display configuration.

In one embodiment, at least one of an outer surface of the first end portion and an outer surface of the second end portion further comprises at least one handle. These handles are provided to facilitate conversion from the stacked configuration to the display configuration, and vice versa.

In accordance with the present invention, the lower edges of the frame portion are further configured to securely engage the bottom portion when the bottom portion and the frame portion are assembled to form the case.

In one embodiment, the lower edges of the first and second end portions and the first and second side portions of the frame have a transversely extending, outwardly oriented first rabbet ledge. In one embodiment, the upper edges of the first and second end portions and the first and second side portions of the frame have a transversely extending, inwardly oriented second rabbet ledge.

In a preferred embodiment, the transport, storage and display system of the present invention comprises a plurality of assembled cases. It is contemplated that the system in the stacked transport/storage configuration may comprise any number of cases, provided that the stacked assembly is transportable. The number of cases that may be considered to be suitable will be determined by the size of the respective individual cases and the resulting overall size of the stacked cases. In one embodiment, the system comprises between 2 to 15 cases.

In accordance with the present invention, an assembled case is configured to stack upon another assembled case. To facilitate stacking, the bottom portion of an upper case is shaped to engage with an upper periphery formed by the upper edges of a lower case.

In a further preferred embodiment, a plurality of upper magnets are provided around the upper periphery of each of the cases, and a plurality of corresponding lower magnets are provided around the periphery of the bottom portion of each of the cases. In this embodiment, the upper magnets and the lower magnets are located to provide secure interaction between adjacent cases when two or more of the cases are in the stacked transport/storage configuration.

In accordance with the present invention, the system further comprises a top portion sized and shaped to provide a cover for the uppermost case of the two or more stacked cases. In one embodiment, the top portion is configured to longitudinally extend between the first and second end portions and transversely extend between the first and second side portions of the frame portion of the uppermost case of two or more cases in the stacked transport/storage configuration.

In one embodiment, the top portion further comprises a downwardly and outwardly facing perimeter rabbet ledge, wherein an outer perimeter surface of the downwardly and outwardly facing perimeter rabbet ledge of the top portion engages an inner surface of the second rabbet ledge of the first side portion, an inner surface of the second rabbet ledge of the second side portion, an inner surface of the second rabbet ledge of the first end portion and an inner surface of the second rabbet ledge of the second end portion of one of the frame portion.

In one embodiment, the top portion is provided with magnets around its periphery. In this embodiment, the top portion magnets are located at positions suitable to interact with the plurality of upper magnets provided around the upper periphery of the case to ensure that the top portion is held securely in place.

In accordance with the present invention, the system further comprises a strapping system comprising one or more straps of a suitable length to wrap around a plurality of storage cases in the stacked transport/storage configuration. In a preferred embodiment, the ends of the straps overlap at the respective ends when wrapped around the stacked cases in the transport/storage configuration. The ends of the straps may be attached to each other using any suitable fastener mechanism known in the art, including, but not limited, to Velcro® (hook and loop) fasteners, or snap fasteners, or buttons.

In one embodiment, the strap(s) are further provided with a series of magnets located to interact with the magnets located on the outer surface of the frame portion of the plurality of cases when the cases are in the stacked transport/storage configuration and the straps are wrapped around the stacked cases.

The strapping system further comprises a handle attached to the strap(s) in a location suitable for convenient transport of the stacked cases. In one embodiment, the handle is removably connected to the straps by a suitable clipping system. In this implementation, the handle may be removed, for example, to access the uppermost case without requiring removal of the magnetically engaged straps while in the stacked transport/storage configuration.

In a further embodiment, the system further comprises wheels attached to the bottom portion of a lowermost case of a plurality of cases in the stacked transport/storage configuration. The wheels are provided to facilitate transport of the cases in the stacked configuration.

In one embodiment, at least one of an inner surface of the second rabbet ledge of the first side portion, the second side portion, the first end portion and the second end portion and at least one of the upper edge of the first side portion, the upper edge of the second side portion, the upper edge of the first end portion, the upper edge of the second end portion are chamfered, rounded or filleted.

In one embodiment, an upper perimeter surface and an inner perimeter surface of the upwardly projecting perimeter rim are chamfered, rounded or filleted.

In one embodiment, a case may be further provided with a false bottom, wherein a perimeter edge of the false bottom is received in the inwardly oriented, extending channel on the lower edges of the first and second end portions and the first and second side portions.

Turning to FIG. 1, one embodiment of a storage case in accordance with the present invention is illustrated. In this embodiment, storage case 10 has a bottom portion 12, a top portion 14, and a frame portion 11 having a first end portion 16, a second end portion 18, a first side portion 20 and a second side portion 22. Further and as will be discussed in further detail below, the storage case 10 has at least one divider portion 30.

In this embodiment, bottom portion 12 is analogous and identical to top portion 14. In other embodiments, it is also contemplated that these two components are not identical such that top portion 14 is only suitable for use as a cover, as will be readily understood by the skilled person. For example, top portion 14 may be formed of a clear material suitable for display purposes, such as a polymeric material or glass. In one embodiment, top portion 14 is formed of polypropylene.

As can be seen in FIG. 1, bottom portion 12 extends longitudinally between a first end and a second end of storage case 10. Further, bottom portion 12 extends transversely between a first side and a second side of storage case 10. In an analogous manner, top portion 14 extends longitudinally between a first end and a second end of storage case 10. Further, bottom portion 14 extends transversely between a first side and a second side of storage case 10. In some embodiments, it is contemplated that at least one of a first end and second end of top portion 14 and a first end or second end of bottom portion 12 optionally includes a handle 41.

In this embodiment, storage case 10 has a first end portion 16 located at a first end of storage case 10 and a second end portion 18 located at a second end of storage case 10. Further, both first end portion 16 and second end portion 18 extend upwardly between bottom portion 12 and top portion 14, and extend transversely between a first side of storage case 10, and second side of storage case 10. In this embodiment, it is contemplated that first end portion 16 or second end portion 18 optionally include one or more handles 40.

As will be readily appreciated by the skilled person, it is contemplated that both the first side portion and second side portion can each be comprised of a single component or any number of multiple components suitably interconnected as required by the needs of the instant application.

In one embodiment, the first side portion and the second side portion are each formed of two or more side portions that, when placed end to end, extend longitudinally between a first end 16 of storage case 10 and a second end 18 of storage case 10 and extend transversely upwardly between bottom portion 12 and top portion 14. In this embodiment and as will be discussed in further detail below, the multiple individual side portions can be interconnected by a tongue and slot interconnection, however other arrangements will also be readily appreciated by the skilled person. In some embodiments it is contemplated that the slot can further include a hole (that communicates with the interior space enclosed by or exterior space surrounding the case) that is adapted to receive adhesive.

In one embodiment, storage case 10 further includes at least one divider portion 30 that extends transversely between the first side and second side of storage case 10 in a manner that can be analogous to both first end portion 12 and second end portion 14, as discussed above.

In a preferred embodiment, the frame portion is provided as a modular system. In such an embodiment, the frame portion is formed from a first end module, a second end module, and a central module.

Figure 2:
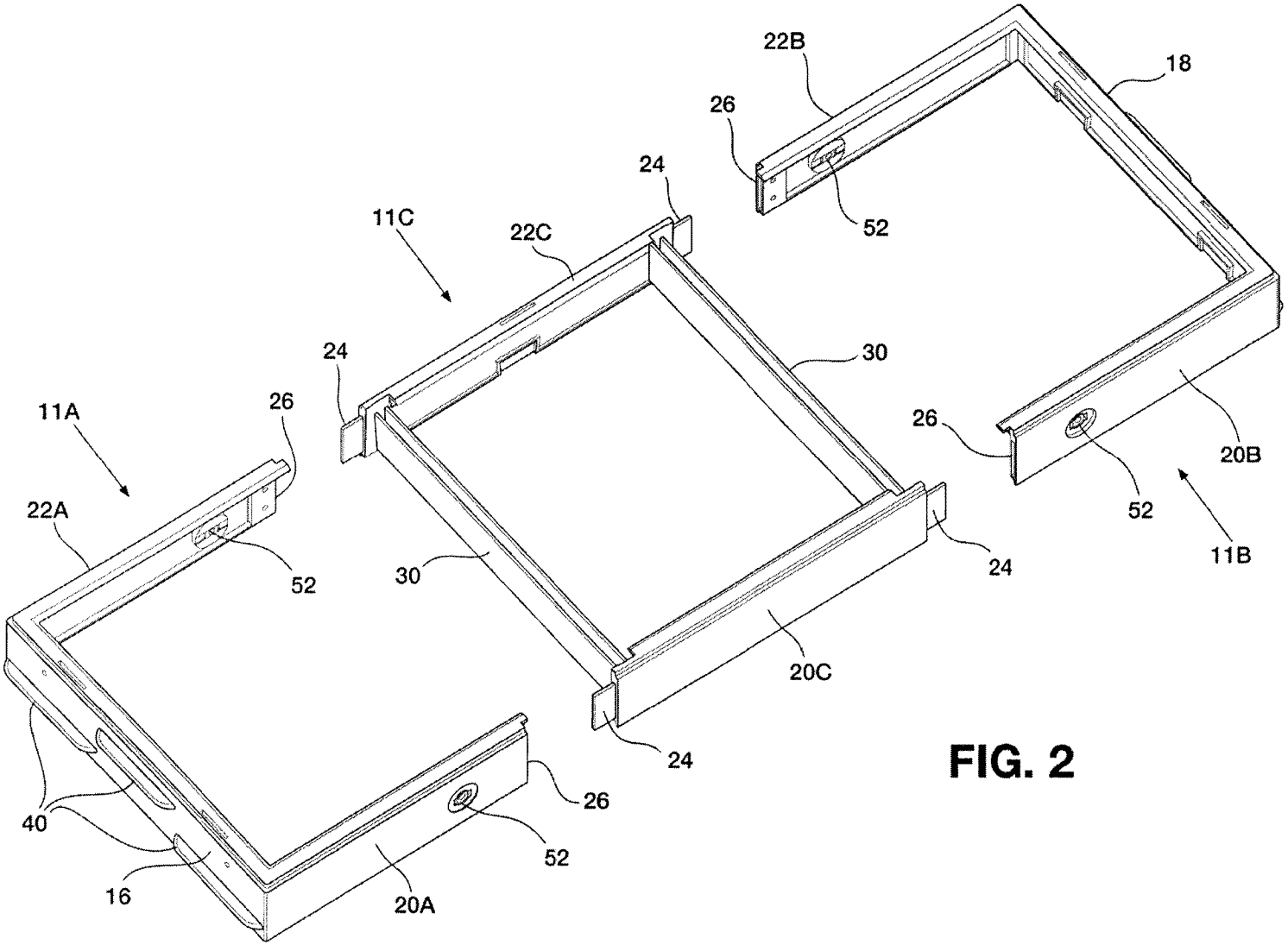
FIG. 2 illustrates an upper perspective view of the disassembled modular frame portion of a storage case, in accordance with one embodiment of the present invention.

Turning to FIG. 2, a disassembled frame portion 11 of the storage case of FIG. 1 in accordance with the modular embodiment of the present invention is illustrated. As depicted in FIG. 2, first end module 11A is formed from first side portion 20A, first end portion 16 and second side portion 22A, and second end module 11B is formed from first side portion 20B, second end portion 18 and second side portion 22B. Also depicted in FIG. 2, central module 11C is formed from first side portion 20C and second side portion 22C, which are connected by two divider portions 30.

In this embodiment, first end portion 16 and a second end portion 18 of the frame portion extend upwardly from bottom portion 12. Further, both first end portion 16 and second end portion 18 also extend transversely between the first and second sides of frame portion 11 of storage case. In this embodiment, it is contemplated that first end portion 16 or second end portion 18 could further and optionally include one or more handles 40.

Figure 3:
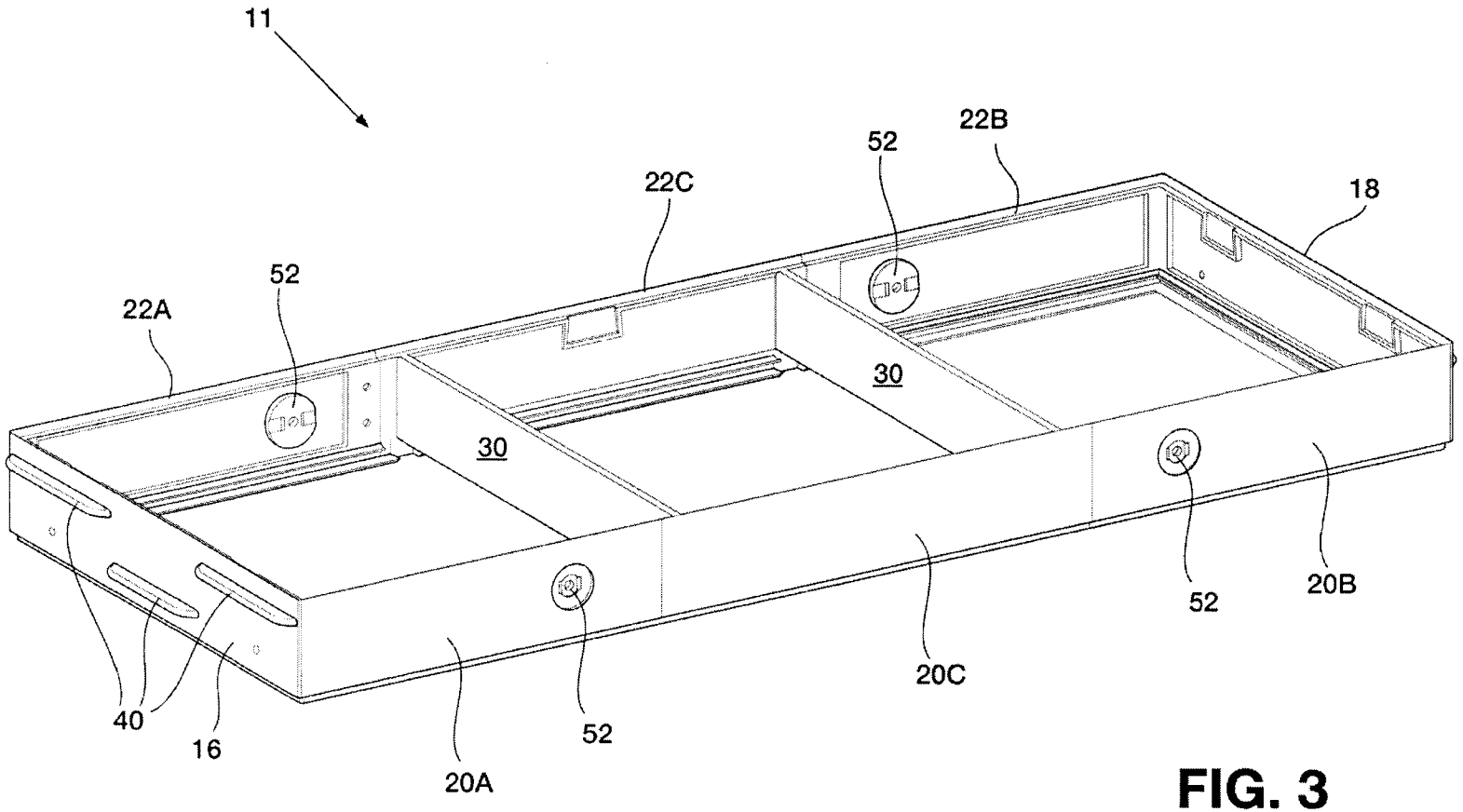
FIG. 3 illustrates a side upper perspective view of the assembled modular frame portion of a storage case, in accordance with one embodiment of the present invention.

Turning to FIG. 3, an assembled frame portion 11 of a storage case in accordance with the modular embodiment of the present invention is illustrated. In this embodiment, the assembled frame portion 11 of storage case includes a first side portion 20 located along a first side of frame portion 11 of storage case and a second side portion 22 located along a second side of frame portion 11 of storage case. In this embodiment, the first side portion 20 is formed of three side portions 20A, 20B and 20C that, when aligned end to end, extend longitudinally between a first end of frame portion 11 of storage case and a second end of frame portion 11 of storage case and which also extend upwardly. In an analogous way, the second side portion 22 is formed of three second side portions 22A, 22B and 22C together extending longitudinally between the first end of frame portion 11 and the second end of frame portion 11 of storage case and which also can extend upwardly.

In the modular embodiment depicted in FIG. 2, side portions 20A, 20B of the two end modules 11A, 11B are configured to engage with a respective end of side portion 20C of the central module. Analogously, side portions 22A, 22B of the two end modules 11A, 11B are configured to engage with a respective end of side portion 22C of the central module. In one embodiment, engagement of the side portions is facilitated with a tongue and slot interconnection. In the embodiment depicted in FIG. 2, tongues 24 are located to project from the central module, while cooperating slots 26 are located on the first and second side portions of each of the end modules to receive the tongues. It is also contemplated that the tongues may alternatively be located on the first and second side portions of each of the end modules, while the respective slots are located on the central module.

Accordingly, each side component has one of a projecting tongue 24 or a cooperating slot 26 such that multiple adjacent side components 20A-C and 22A-C can be interconnected to result in a single continuous side portion that extends longitudinally from the first end portion 16 to the second end portion 18 of the frame portion 11 of the storage case, as will be discussed in further detail below.

As depicted in FIGS. 1 to 4, a number of additional features related to the transport, storage and display aspects of the present invention are illustrated that can be included on any of the first end portion, the second end portion, the first side portion and the second side portion, depending on the needs of the eventual end-user application of the present invention.

For example, in a preferred embodiment, one or more recesses 50 may be provided along the upper edge of frame portion 11, for example, on an upper edge of the end portions 16, 18, on an upper edge of the first side portion 20 and/or on an upper edge of the second side portion 22. These recesses each provide a mounting surface for an upper magnet. In a further embodiment, a corresponding lower magnet is located on a lower edge of the end portions 16, 18, on a lower edge of the first side portion 20 and/or on a lower edge of the second side portion 22. In an alternative embodiment, the corresponding lower magnet is located around the periphery of the bottom portion. In each of these embodiments, the lower magnets are located to correspond to the locations of the magnet(s) on the upper edges to ensure that stacked storage cases are held securely through magnetic attraction.

In a further preferred embodiment, first side portion 20 and second side portion 22 (and optionally end portions 16, 18) are each provided with one or more secondary recesses 52 on an outer surface. These secondary recesses each house a magnet. In this embodiment, the magnet(s) on the first side portions are each located to correspond to the magnet(s) on the second side portions such that when storage cases are placed side by side each other in a display configuration, adjacent cases are held securely through magnetic attraction.

Figure 4:
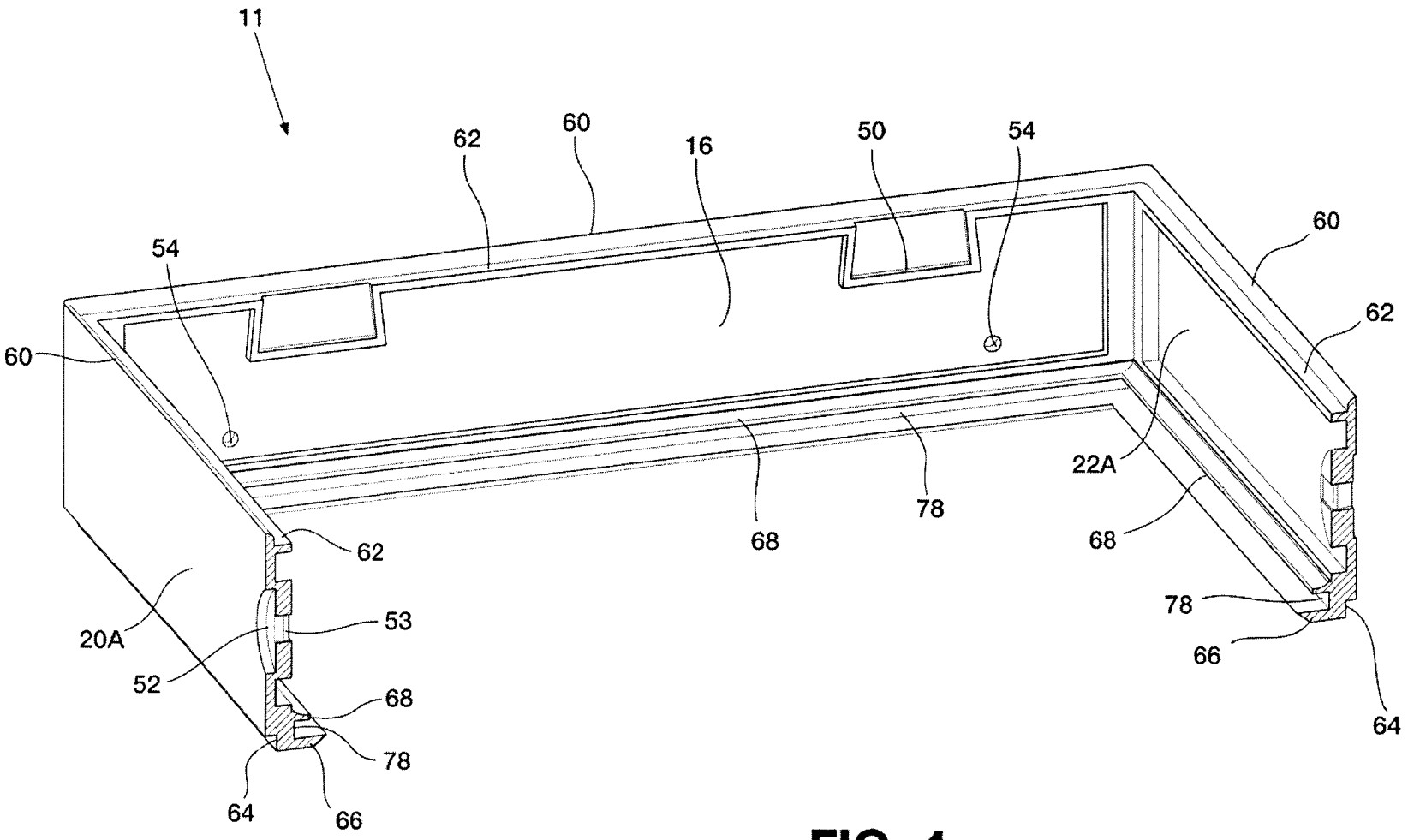
FIG. 4 illustrates a perspective view of one of the end portions of a storage case showing the side portions in cross section, in accordance with one embodiment of the present invention.

Further, it is contemplated that in some embodiments, secondary recess 52 is circular in shape and can optionally include a centrally located bore hole 53 as shown in FIG. 4, however other arrangements will be readily appreciated by the skilled person.

It is also contemplated that end portion 16, 18 (or analogously, first side portion 20 or second side portion 22) can optionally include a bore hole 54 that permits a user to mount a label or sign with a cooperating detent.

Figure 5:
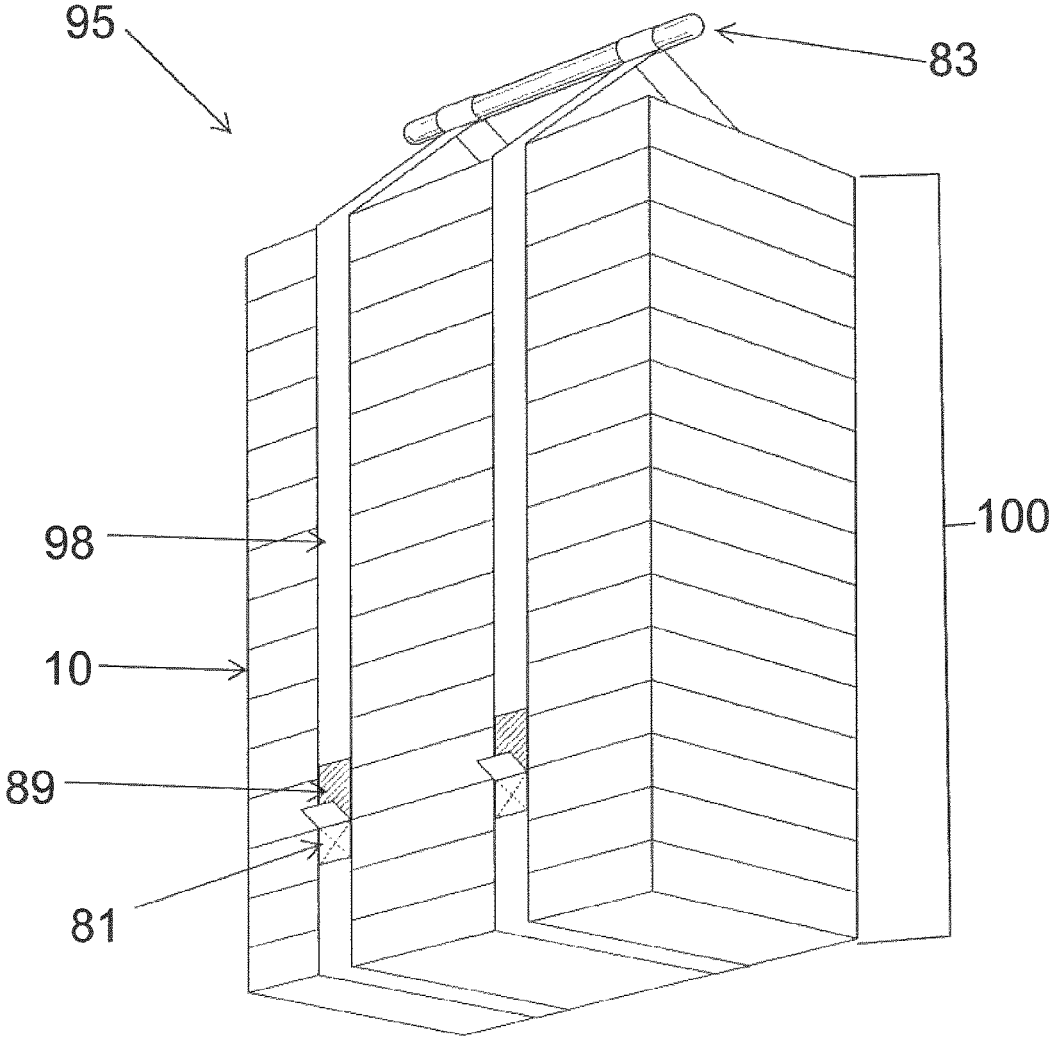
FIG. 5 illustrates a plurality of storage cases in a stacked transportation configuration with a carrying strap system, in accordance with one embodiment of the present invention.

Turning to FIG. 5, a plurality of cases 100 are shown in a stacked transport/storage configuration 95 with strapping system installed. In this embodiment, strapping system 90 includes handle 83 and one or more straps 98 suitably sized to wrap around the plurality of storage cases 10 in the stacked transportation configuration to facilitate transportation.

Figure 6A:
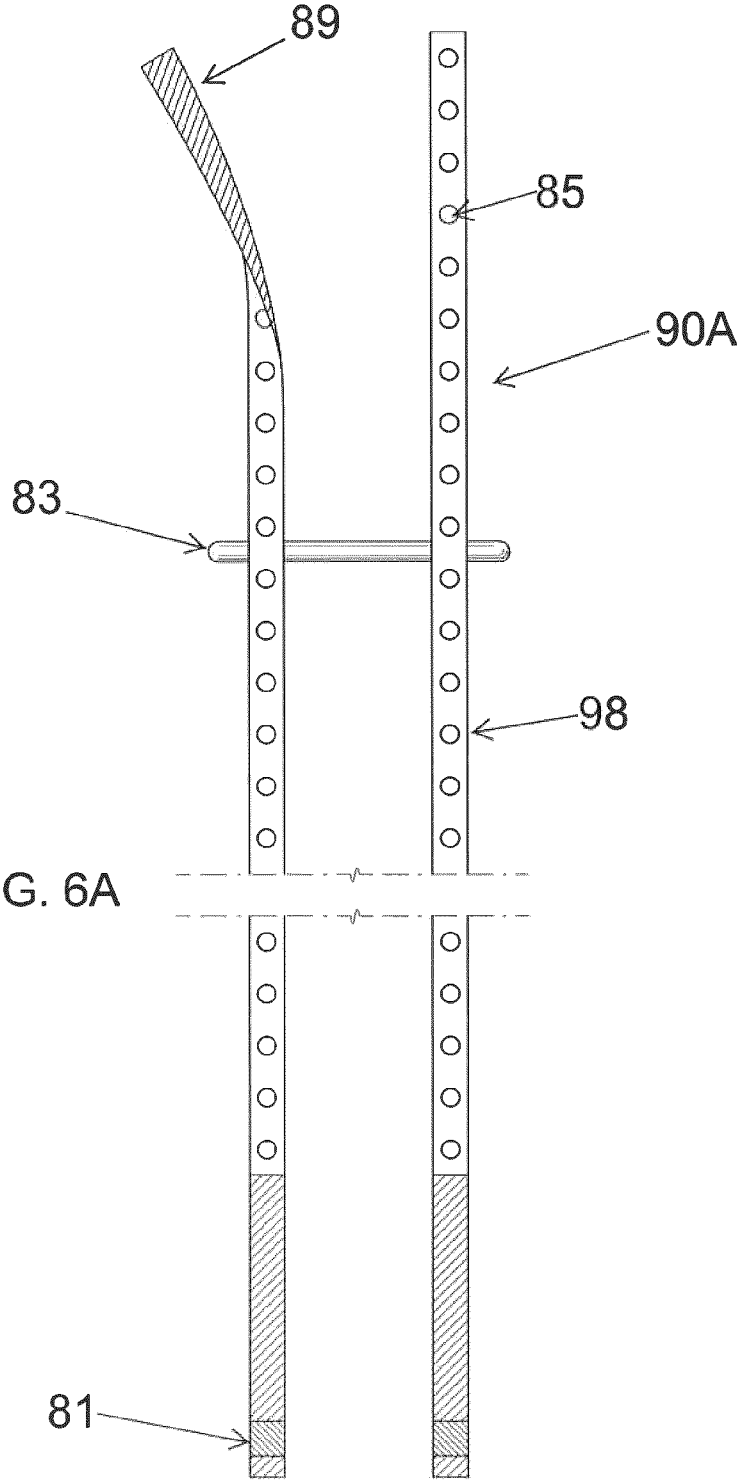
FIGS. 6A and 6B illustrate carrying strap systems, in accordance with embodiments of the present invention.
Figure 6B:
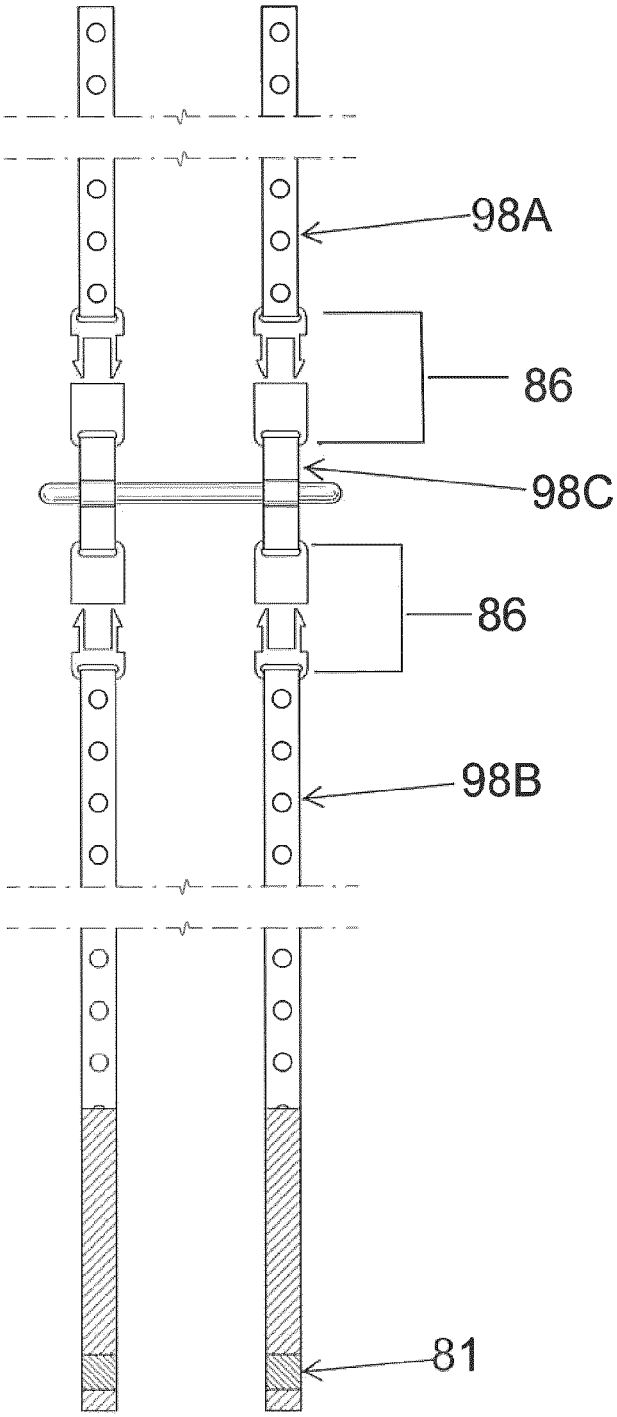

In the embodiment of a strapping system 90A shown in FIG. 6A, each strap 98 is formed of a single piece, with the handle being attached to the strap(s) in a location suitable for convenient In the embodiment of a strapping system 90B shown in FIG. 6B, each strap is formed from a first end section 98A, second end section 98B and central section 98C, wherein end sections 98A,B are removably attached to central section 98C. As depicted in FIG. 6B, end sections 98A,B are attached to central section 98C using a clip system 86. Handle 83 is attached to central portion 98C.

As depicted in FIGS. 6A and 6B, strap(s) 98 are provided with a plurality of magnets 85 located to correspond to, and interact with, magnets on the individual storage cases to provide additional security during transportation. Also depicted in FIGS. 5, 6A and 6B are hook and loop fastener zones 81 and 89, which cooperatively interact to fasten the straps in place for secure transportation.

Turning to FIG. 4, a cross-sectional view of the side portions of frame portion 11 of a storage case in accordance with the present invention is illustrated. In this embodiment, it is contemplated that first side portion 20, second side portion 22 and end portions 16, 18 each have a similar cross sectional shape. It is further contemplated that the upper, inner edges of the first side portion 20, second side portion 22, and end portions 16, 18 are finished with an inwardly and upwardly facing rabbet ledge 62 (i.e., a cutout ledge having two perpendicular walls). Other profile shapes are also contemplated as required by the particular embodiment and as will be readily appreciated by the skilled person.

In some embodiments, it is also contemplated that the lower, outer edges of the first side portion 20, second side portion 22, and end portions 16, 18 are finished with an outwardly and downwardly facing rabbet ledge 64 (i.e., a cutout ledge having two perpendicular walls). Other profile shapes are also contemplated as required by the particular embodiment and as will be readily appreciated by the skilled person.

In some embodiments, it is contemplated that the lower, inner edge of at least one of the first side portion 20, second side portion 22, or end portion 16, 18 can further include an inwardly projecting flange 66. In one embodiment, bottom portion 12 is configured to rest on the inwardly oriented flange (not shown). In some embodiments, it is contemplated that inwardly projecting flange 66 is perpendicularly oriented to, for example, first side portion 20, second side portion 22, or end portion 16, 18 as will be readily understood by the skilled person. Further, it is contemplated that the distal edge of inwardly projecting flange 66 can be finished with a chamfer, among other finishing arrangements that will be readily appreciated by the skilled person.

In some embodiments, it is contemplated that the lower, inner surface of at least one of the first side portion 20, second side portion 22, or end portion 16, 18 can further include a secondary inwardly projecting flange 68 that is spaced apart from inwardly projecting flange 66. In some embodiments, it is contemplated that secondary inwardly projecting flange 68 can also be perpendicularly oriented to, for example, first side portion 20, second side portion 22, or end portion 16, 18 as will be readily appreciated by the skilled person. Further, it is contemplated that an upper side of the secondary inwardly projecting flange 68 can be finished with a rounded fillet, among other finishing arrangements that will be readily appreciated by the skilled person.

In this embodiment inwardly projecting flange 66 and secondary inwardly projecting flange 68 define an inwardly opening channel 78 therebetween. In one embodiment, bottom portion 12 is configured to fit within the inwardly opening channel (not shown). As will be appreciated by the skilled person, in some embodiments channel 78 will extend fully around the perimeter of the lower inner surface of frame portion 11 of the storage case. In other embodiments, it is contemplated that channel 78 only extends partially around the lower inner surface of frame portion 11 of the storage case in a discontinuous manner.

In one embodiment, it is contemplated that a false bottom (not shown) can also be held within channel 78. It is contemplated that the false floor can be manufactured of polymer, cardboard, felt or any other suitable material as will be readily appreciated by the skilled person.

Turning back to FIG. 1, in one embodiment, it is contemplated that top portion 14 further includes an upwardly projecting perimeter rim 72 on an upper surface, and an outer perimeter upper edge of frame portion 11 includes an inwardly facing rabbet ledge 62. Therefore, in this embodiment (and with reference to FIG. 1), when bottom portion 12, top portion 14 and frame portion 11 are assembled into a resultant storage case 10, an inner perimeter surface of rabbet ledge 62 of frame portion 11 engages an outer surface of rabbet ledge 70 of top portion 14 in order to retain top portion 14 in place as a cover for the case.

Further, in embodiments that include secondary recesses, multiple storage cases can be aligned side by side in a transverse manner and interconnected by way of magnets or any other suitable connectors.

It is further contemplated that a cover can be provided in order to provide protection to multiple interconnected, stacked storage cases. In this way, the storage case system can be secured and further protected from rain, prying eyes, or being upset during transport.

It will be readily understood that all components discussed herein can be constructed of any suitable materials including but not limited to polymeric materials, wood, cardboard. Further, all components discussed herein can be manufactured by any suitable process that will be readily appreciated by the skilled person.

It is obvious that the foregoing embodiments of the invention are examples and can be varied in many ways. Such present or future variations are not to be regarded as a departure from the spirit and scope of the invention, and all such modifications as would be obvious to one skilled in the art are intended to be included within the scope of the following claims.

The scope of the claims should not be limited by the preferred embodiments set forth in the description, but should be given the broadest interpretation consistent with the description as a whole.

The embodiments of the invention for which an exclusive property or privilege is claimed are defined as follows:

1. A transport, storage and display case system convertible between a display configuration and a stacked transport/storage configuration, the system comprising:

(i) two or more stackable cases, each case comprising:

a bottom portion, the bottom portion having a first end and a second end and a first side and a second side; and a frame portion associated with said bottom portion, the frame portion comprising:

a first end portion upwardly projecting from the first end of the bottom portion and transversely extending between the first side and the second side;

a second end portion upwardly projecting from the second end of the bottom portion and transversely extending between the first side and the second side;

a first side portion, the first side portion extending from the first end of the bottom portion to the second end of the bottom portion and projecting upwardly from the first side of the bottom portion; and a second side portion, the second side portion extending from the first end of the bottom portion to the second end of the bottom portion and projecting upwardly from the second side of the bottom portion; and projecting upwardly from the second side of the bottom portion; and wherein each of said first side portion and said second side portion further comprise one or more magnets located on an outer surface, the magnets being provided to facilitate secure interaction between adjacent cases arranged in the display configuration, and wherein the first end portion, the second end portion, the first side portion, and the second side portion of the frame portion each have an upper edge and a lower edge, the lower edges having an outwardly oriented first rabbet ledge, the upper edges having a transversely extending, inwardly oriented second rabbet ledge, and the upper edges together forming an upper periphery of a case; and (ii) a top portion, the top portion being configured to longitudinally extend between the first end portion and the second end portion and transversely extend between the first side portion and the second side portion of the frame portion of the uppermost case of two or more cases in the stacked transport/storage configuration;

wherein the bottom portion is configured to engage the lower edges of the first end portion, the second end portion, the first side portion, and the second side portion; and wherein the bottom portion of an upper case is shaped to engage with the upper periphery of a lower case when two or more of said cases are in the stacked transport/storage configuration.

2. The system of claim 1 further comprising at least one divider portion having a first end and a second end, the divider portion transversely extending between the first side and the second side, the divider portion upwardly extending between the bottom portion and the top portion, the first end of the divider portion abutting an inner surface of the first side portion, the second end of the divider portion abutting an inner surface of the second side portion.

3. A transport, storage and display case system convertible between a display configuration and a stacked transport/storage configuration, the system comprising:

(i) two or more stackable cases, each case comprising:

a bottom portion, the bottom portion having a first end and a second end and a first side and a second side; and a modular frame portion associated with said bottom portion, the modular frame portion comprising:

a central module comprising a first central side portion, a second central side portion, and at least one divider portion transversely extending between the first central side portion and the second central side portion;

wherein the first central side portion projects upwardly from a central region of the first side of the bottom portion and the second central side portion projects upwardly from a central region of the second side of the bottom portion;

a first end module comprising a first end portion upwardly projecting from the first end of the bottom portion and transversely extending between the first side and the second side of the bottom portion, and two first end side portions, one of the first end side portions longitudinally extending from the first end portion along the first side of the bottom portion toward the first central side portion of the central module and the other of the first end side portions longitudinally extending from the first end portion along the second side of the bottom portion toward the second central side portion of the central module; and a second end module comprising a second end portion upwardly projecting from the second end of the bottom portion and transversely extending between the first side and the second side of the bottom portion, and two second end side portions, one of the second end side portions longitudinally extending from the second end portion along the first side of the bottom portion toward the first central side portion of the central module and the other of the second end side portions longitudinally extending from the second end portion along the second side of the bottom portion toward the second central side portion of the central module;

wherein one of the first end side portions, one of the second end side portions and the first central portion form a first side portion of the modular frame portion, and the other of the first end side portions, the other of the second end side portions and the second central portion form a second side portion of the modular frame portion;

wherein the first end portion, the second end portion, the first side portion, and the second side portion of the modular frame portion each have an upper edge and a lower edge, the lower edges having a transversely extending, outwardly oriented first rabbet ledge, the upper edges having a transversely extending, inwardly oriented second rabbet ledge, and the upper edges together form an upper periphery of a case; and wherein each of the first side portion and the second side portion of the modular frame portion further comprise one or more magnets located on an outer surface, the magnets being provided to facilitate secure interaction between adjacent cases arranged in the display configuration; and (ii) a top portion, the top portion being configured to longitudinally extend between the first end portion and the second end portion and transversely extend between the first side portion and the second side portion of the modular frame portion of the uppermost case of two or more cases in the stacked transport/storage configuration;

wherein the bottom portion is configured to engage the lower edges of the first end portion, the second end portion, the first side portion, and the second side portion of the frame portion; and wherein the bottom portion of an upper case is shaped to engage with the upper periphery of a lower case when two or more of said cases are in the stacked transport/storage configuration.

4. The system of claim 3, wherein the central side portion is connected to each of the first and second end side portions via a tongue and slot arrangement, wherein a projecting tongue on one portion projects into a corresponding slot on an adjacent portion.

5. The system of claim 4, wherein the projecting tongue is secured within the corresponding slot with an adhesive or a screw.

6. The system of claim 1, wherein the lower edges of the first end portion, the second end portion, the first side portion, and the second side portion of the frame portion have an inwardly oriented flange, wherein the bottom portion is configured to rest on the inwardly oriented flange.

7. The system of claim 1, wherein the lower edges of the first end portion, the second end portion, the first side portion, and the second side portion of the frame portion have an inwardly oriented channel, wherein the bottom portion is configured to fit within the inwardly oriented channel.

8. The system of claim 1, wherein the top portion further comprises a downwardly and outwardly facing perimeter rabbet ledge, wherein an outer perimeter surface of the downwardly and outwardly facing perimeter rabbet ledge of the top portion engages an inner surface of the second rabbet ledge of the first side portion, an inner surface of the second rabbet ledge of the second side portion, an inner surface of the second rabbet ledge of the first end portion and an inner surface of the second rabbet ledge of the second end portion of one of the frame portion.

9. The system of claim 1, further comprising a plurality of upper magnets located around the upper periphery of each said case, and a plurality of lower magnets located around the lower periphery of each said case, wherein the upper magnets and the lower magnets are located to provide secure interaction between adjacent cases when two or more of said cases are in the stacked transport/storage configuration.

10. The system of claim 1, further comprising a strapping system comprising one or more straps suitably sized to wrap around the plurality of storage cases in the stacked transport/storage configuration to facilitate transportation, and a handle attached to said one or more straps.

11. The system of claim 10, wherein the one or more straps further comprise a plurality of magnets located to interact with said one or more magnets located on the outer surface of the frame portion of the two or more cases when the two or more cases are in the stacked transport/storage configuration.

12. The system of claim 10, wherein the one or more straps further comprise a fastener system selected from hook and loop fasteners, snap fasteners, and buttons, wherein the fastener system is provided to secure the ends of the one or more straps together.

13. The system of claim 1, wherein at least one of an outer surface of the first end portion and an outer surface of the second end portion of the frame portion further comprises at least one handle.

14. The system of claim 1, wherein at least one of an inner surface of the second rabbet ledge of the first side portion, an inner surface of the second rabbet ledge of the second side portion, an inner surface of the second rabbet ledge of the first end portion and an inner surface of the second rabbet ledge of the second end portion and at least one of the upper edge of the first side portion, the upper edge of the second side portion, the upper edge of the first end portion, the upper edge of the second end portion are chamfered, rounded or filleted.

15. The system of claim 1, further comprising four wheels attached to a lower surface of the bottom portion of a lowermost case.

16. A case suitable for use in a transport, storage and display case system convertible between a display configuration and a stacked transport/storage configuration, the case comprising:

a bottom portion, the bottom portion having a first end and a second end and a first side and a second side; and a modular frame portion associated with said bottom portion, the modular frame portion comprising:

a central module comprising a first central side portion, a second central side portion, and at least one divider portion transversely extending between the first central side portion and the second central side portion;

wherein the first central side portion projects upwardly from a central region of the first side of the bottom portion and the second central side portion projects upwardly from a central region of the second side of the bottom portion;

a first end module comprising a first end portion upwardly projecting from the first end of the bottom portion and transversely extending between the first side and the second side of the bottom portion, and two first end side portions, one of the first end side portions longitudinally extending from the first end portion along the first side of the bottom portion toward the first central side portion of the central module and the other of the first end side portions longitudinally extending from the first end portion along the second side of the bottom portion toward the second central side portion of the central module; and a second end module comprising a second end portion upwardly projecting from the second end of the bottom portion and transversely extending between the first side and the second side of the bottom portion, and two second end side portions, one of the second end side portions longitudinally extending from the second end portion along the first side of the bottom portion toward the first central side portion of the central module and the other of the second end side portions longitudinally extending from the second end portion along the second side of the bottom portion toward the second central side portion of the central module;

wherein one of the first end side portions, one of the second end side portions and the first central portion form a first side portion of the modular frame portion, and the other of the first end side portions, the other of the second end side portions and the second central portion form a second side portion of the modular frame portion;

wherein the first end portion, the second end portion, the first side portion, and the second side portion of the modular frame portion each have an upper edge and a lower edge, the lower edges having a transversely extending, outwardly oriented first rabbet ledge, the upper edges having a transversely extending, inwardly oriented second rabbet ledge, and the upper edges together form an upper periphery of a case; and wherein each of the first side portion and the second side portion of the modular frame portion further comprise one or more magnets located on an outer surface, the magnets being provided to facilitate secure interaction when two or more of said cases are arranged in the display configuration; and (ii) a top portion, the top portion being configured to longitudinally extend between the first end portion and the second end portion and transversely extend between the first side portion and the second side portion of the modular frame portion;

wherein the bottom portion is configured to engage the lower edges of the first end portion, the second end portion, the first side portion, and the second side portion of the frame portion; and wherein a plurality of upper magnets are located around the upper periphery of said case, and a plurality of lower magnets located around the lower periphery of said case, wherein the upper magnets and the lower magnets are located to provide secure interaction between adjacent cases when two or more of said cases are in the stacked transport/storage configuration.

* * * * *